US008003924B2

(12) United States Patent
Kim et al.

(10) Patent No.: US 8,003,924 B2
(45) Date of Patent: Aug. 23, 2011

(54) COOKING APPLIANCE

(75) Inventors: Won Tae Kim, Seoul (KR); Seung Hee Ryu, Gunpo-si (KR); Byeong Wook Park, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 227 days.

(21) Appl. No.: 11/956,021

(22) Filed: Dec. 13, 2007

(65) Prior Publication Data

US 2008/0142512 A1 Jun. 19, 2008

(30) Foreign Application Priority Data

Dec. 14, 2006 (KR) ..... 10-2006-0127526

(51) Int. Cl.
*H05B 6/12* (2006.01)
*H05B 6/10* (2006.01)
*H05B 6/42* (2006.01)

(52) U.S. Cl. ..... 219/623; 219/632; 219/677

(58) Field of Classification Search ..... 219/623, 219/632, 677, 620, 391, 757, 443.1; 165/80.3
See application file for complete search history.

(56) References Cited

U.S. PATENT DOCUMENTS

| | | | | |
|---|---|---|---|---|
| 4,490,596 | A * | 12/1984 | Hirai et al. | 219/623 |
| 5,158,136 | A * | 10/1992 | Azar | 165/185 |
| 5,504,650 | A * | 4/1996 | Katsui et al. | 361/697 |
| 6,670,699 | B2 * | 12/2003 | Mikubo et al. | 257/678 |
| 2002/0170905 | A1 * | 11/2002 | Peterson et al. | 219/443.1 |
| 2004/0149752 | A1 * | 8/2004 | Yamaguchi et al. | 219/757 |

FOREIGN PATENT DOCUMENTS

JP 10012781 A * 1/1998

* cited by examiner

*Primary Examiner* — Quang T Van
*Assistant Examiner* — Hung Nguyen
(74) *Attorney, Agent, or Firm* — Birch, Stewart, Kolasch & Birch, LLP

(57) ABSTRACT

A cooking appliance includes at least one heating element; a heat sink connected to the heating element, to radiate heat generated by the heating element; a cooling fan located at one side of the heat sink, to blow cooling air to the heat sink; and a flow guide covering at least a portion of the heat sink and guiding a portion of the cooling air to flow to the heating element.

20 Claims, 7 Drawing Sheets

COOKING APPLIANCE

CROSS-REFERENCE TO RELATED APPLICATIONS

This nonprovisional application claims priority under 35 U.S.C. §119(a) on Patent Application No. 10-2006-0127526, filed in Korea on Dec. 14, 2006, the entirety of which is incorporated herein by reference.

BACKGROUND OF THE INVENTION

1. Field of the Invention

The present invention relates to a cooking appliance, and more particular, to a cooking appliance efficiently cooling electric heating elements thereof.

2. Background of the Invention

Cooking appliances generally heat and cook food. Such cooking appliances are classified into gas and electric cooking appliances based on the types of heat sources they employ.

A cooking appliance includes a heating unit for generating heat using electricity or gas, a case for receiving the heating unit, and a plate disposed on the case. A food container for containing food is placed on the plate, and then the food is cooked by heat generated from the heating unit. A plurality of electric elements is provided in the cooking appliance for the operations thereof.

However, in a related art cooking appliance, since the electric elements cannot be efficiently cooled, malfunction and damage of the cooking appliance occurs due to overheated electric elements and/or excessive overheating.

SUMMARY OF THE INVENTION

It is an object of the present invention to provide a cooking appliance that efficiently cools electric heating elements.

To achieve the above-mentioned object, according to a first aspect of the present invention, a cooking appliance includes: at least one heating element; a heat sink connected to the heating element, to radiate heat generated by the heating element; a cooling fan located at one side of the heat sink, to blow cooling air to the heat sink; and a flow guide covering at least a portion of the heat sink and guiding a portion of the cooling air to flow to the heating element.

According to a second aspect of the present invention, a cooking appliance includes: a heating element; a heat sink configured to dissipate heat of the beating element; a cooling fan configured to provide cooling air; and a flow guide defining an element cooling passage to guide the cooling air blown by the cooling fan to directly flow toward the heating element.

According to a third aspect of the present invention, a cooking appliance includes: a base; an electric element located in the base; a heat sink connected to the electric element and including a plurality of heating fins; a first cooling passage defined between every two immediately adjacent heating fins; a flow guide defining a second cooling passage separated from the first cooling passage, to cool the electric element; and a cooling fan blowing cooling air into the first cooling passage and the second first cooling passage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE ILLUSTRATED EMBODIMENTS

Figure 1:
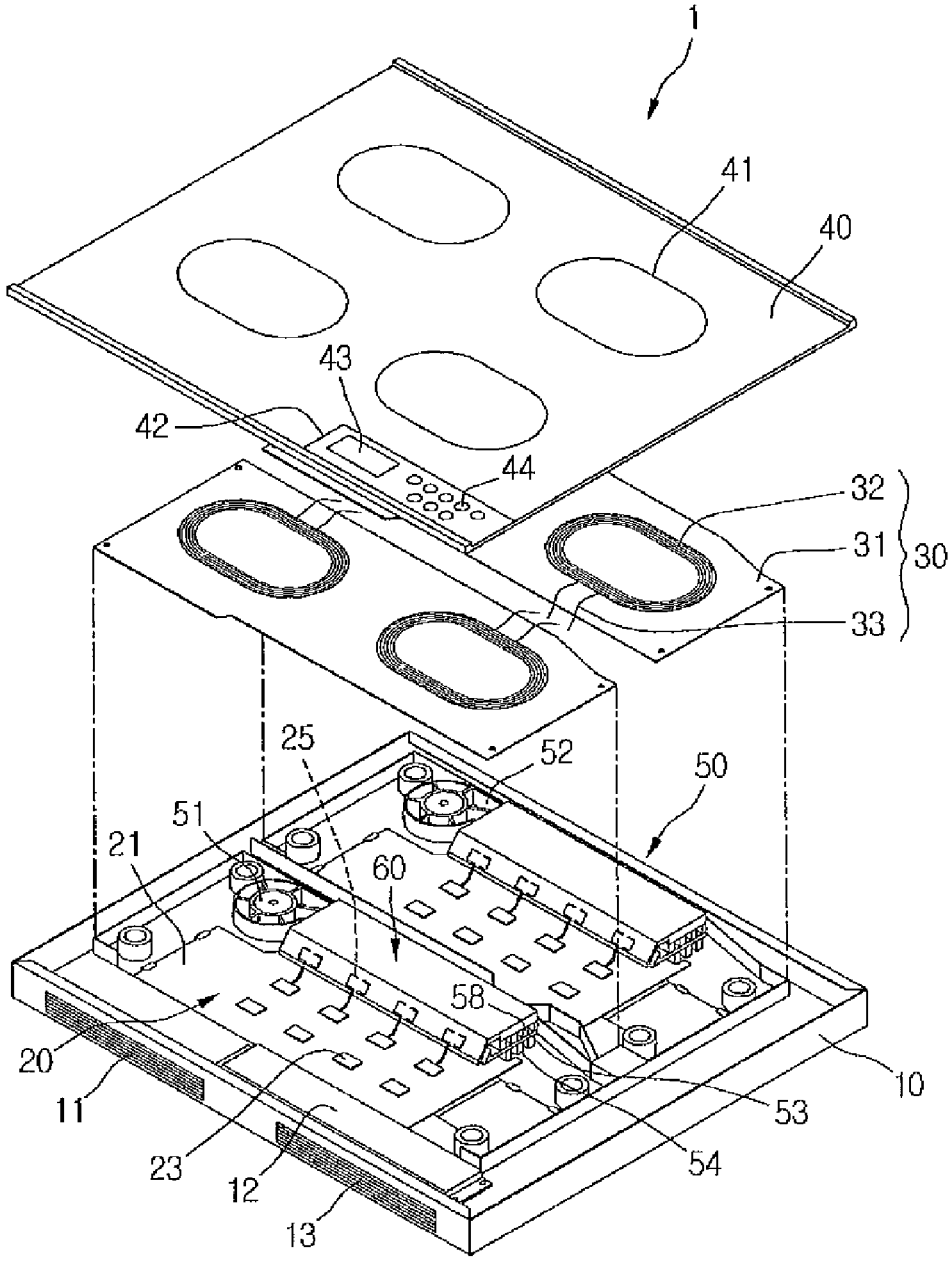
FIG. 1 is a perspective view of a cooling appliance according to a first embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

FIG. 1 is a perspective view of a cooking appliance according to a first embodiment of the present invention. Referring to FIG. 1, a cooking appliance 1 according to the illustrated embodiment includes a case 10, a plate 40, an induction heating unit 30, at least one inverter module 20, at least one cooling unit 50, and a controller 12. The plate 40 is located above the case 10 and a cooking container can be disposed thereon. The induction heating unit 30 is located within a space defined by the case 10 and the plate 40. The inverter module 20 supplies AC electrical power to the induction heating unit 30. The cooling unit 50 cools electric heating elements 25 among electric elements 23 of the inverter module 20. The controller 12 controls the operations of the cooking appliance 1.

Specifically, the case 10 is formed in a box shape with an opened top. A cooling air suction port 11 and a cooling air discharge port 13 are formed in the front of the case 10, and the cooling air discharge port 13 is separated from the cooling air suction port 11 by a predetermined distance. Cooling air suctioned through the cooling air suction port 11 passes through the cooling unit 50 and then is discharged through the cooling air discharge port 13.

The inverter module 20 is installed inside the case 10. The inverter module 20 includes a circuit board 21 and a plurality of electric elements 23 (including the electric heating element 25) formed on the circuit board 21.

The electric heating element 25 having a relatively large heat value among the electric elements 23 is coupled to the cooling unit 50 that will be described below.

The induction heating unit 30 is located above the inverter module 20. The induction heating unit 30 includes at least one base 31 and at least one inductor coil 32. A terminal 33 of the inductor coil 32 is electrically connected to the inverter module 20. The induction heating unit 30 converts a high frequency DC current supplied by the inverter module 20 into a DC magnetic field, and provides the DC magnetic field to the plate 40. A mica sheet (not shown) is provided between the inductor coil 32 and the base 31.

The mica sheet is located above the induction heating unit 30, to prevent heat generated by the cooking appliance 1 from being transferred to a ferrite that will be described below. The ferrite (not shown) is located below the mica sheet, to diffuse a DC magnetic field generated by the inductor coil 32.

At least one receiving portion 41 for receiving a cooking container is provided on the top surface of the plate 40. The receiving portion 41 corresponds in a position to the induction heating unit 30. A controller 42 is located at one side of the front portion of the plate 40. The controller 42 includes a display unit 43 and a plurality of operation buttons 44. The display unit 43 displays an operation state of the cooking appliance 1.

Hereinafter, the cooling unit 50 will be described with reference to the drawings.

Figure 2:
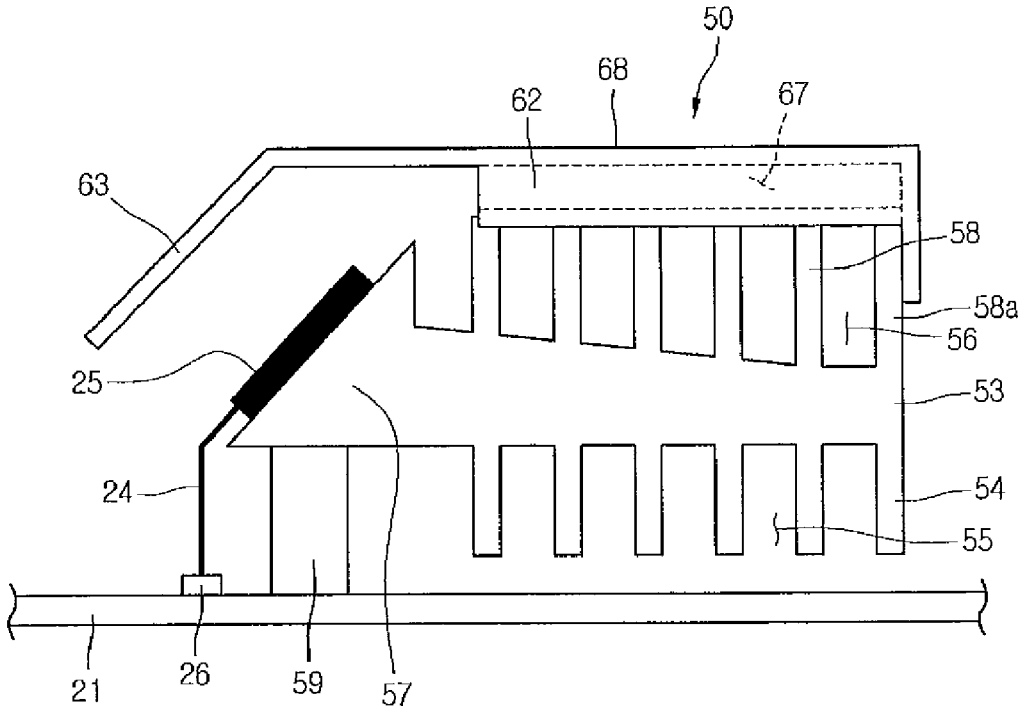
FIG. 2 is a cross-sectional view of the cooling unit according to the first embodiment of the present invention.
Figure 3:
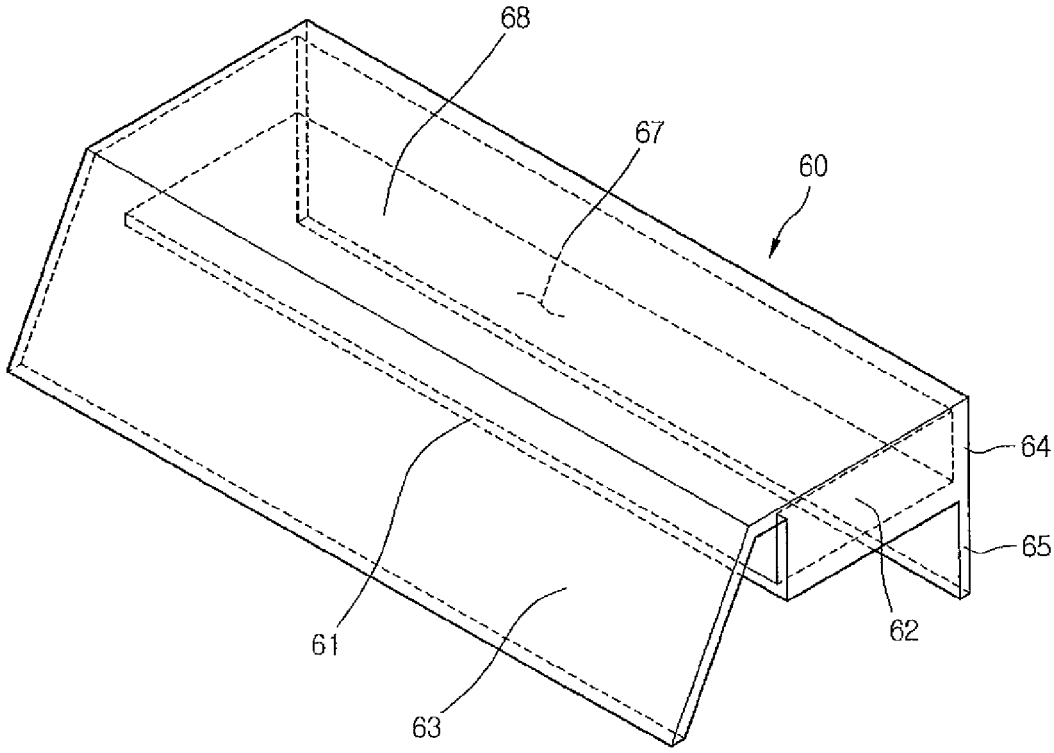
FIG. 3 is a perspective view of a flow guide according to the first embodiment of the present invention.

FIG. 2 is a cross-sectional view of the cooling unit 50 according to the first embodiment, and FIG. 3 is a perspective view of a flow guide according to the first embodiment. Referring to FIGS. 1-3, the cooling unit 50 includes a heat sink 53, a cooling fan 51/52, and a flow guide 60. The heat sink 53 is coupled to the electric heating element 25. The cooling fan 51/52 is located at one side of the heat sink 53, and the flow guide 60 is located above the heat sink 53.

In detail, a plurality of supporting portions 59 are disposed below the heat sink 53 and are coupled at predetermined intervals to the circuit board 21.

A coupling portion 57 that is coupled to the electric heating element 25 is formed in one side of the heat sink 50. A material (not shown) having a high heat conductivity and insulating property is inserted between the coupling portion 57 and the electric heating element 25, to electrically insulate between the coupling portion 57 and the electric heating element 25 and allow heat to be easily transferred. The terminal 24 of the electric heating element 25 is electrically connected to a terminal connecting unit 26 of the circuit board 21.

The electric heating element 25 may include a rectifying diode and a transistor as a semiconductor element that can perform a high speed switching operation. The electric heating element 25 is an electric element that has a large heat value among the electric elements 23. The electric heating element 25 may be some or all of the electric elements 23 that need to be cooled.

A plurality of heating fins are formed on the heat sink 53. The heating fins are spaced apart from each other by a predetermined distance, and every two immediately adjacent heating fins respectively define a cooling passage therebetween. The heating fins include a plurality of top heating fins 58 formed on the top of the heat sink 53, and a plurality of bottom heating fins 54 formed on the bottom of the heat sink 53. The cooling passages include a plurality of top cooling passages 56 and a plurality of bottom cooling passages 55.

The flow guide 60 is located above the heat sink 53, to cover the top heating fins 58 and guide a portion of air blown from the cooling fan 51 to the electric heating element 25. Specifically, the flow guide 60 includes a bottom plate 61, a top plate 68, a first connecting plate 64, a second connecting plate 62, a coupling plate 65, and a guiding plate 63. The bottom plate 61 contacts the tops of the top heating fins 58, and the top plate 68 is spaced apart upwardly from the bottom plate 61. The first connecting plate 64 connects the first end of the top plate 68 and the first end of the bottom plate 61, and the second connecting plate 62 connects the second end of the top plate 68 and the second end of the bottom plate 61. The coupling plate 65 extends downward from the first connecting plate 64, to enable the flow guide 60 to be coupled to the heat sink 53. The guiding plate 63 extends slantingly downward from the top plate 68, to cover the electric heating element 25.

In detail, an element cooling passage 67, through which the air blown from the cooling fan flows, is formed between the top plate 68 and the bottom plate 61. Here, the top cooling passage 56 formed by the top heating fins 58 is designated as a first cooling passage, and the element cooling passage 67 formed between the top plate 68 and the bottom plate 61 is designated as a second cooling passage.

The bottom plate 61 is disposed on the top heating fins 58, to separate the top cooling passage 56 from the element cooling passage 67. That is, the bottom plate 61 prevents mixing of the air in the top cooling passage 56 with the air in the element cooling passage 67. Thus, the bottom plate 61 may be called a separating plate. The air introduced into the top cooling passage 56 cools the heat sink 53, and the air introduced into the element directly cools the electric heating element 25.

The coupling plate 65 is coupled to the outer surface of a heating fin 58*a* that extends upward from one end of the heat sink 53. The second connecting plate 62 extends from the first connecting plate 64 at a predetermined angle. In the illustrated embodiment, the second connecting plate 62 is substantially perpendicular to the first connecting plate 64. The second connecting plate 62 changes the flowing direction of the air within the element cooling passage 67 when the air reaches the second connecting plate 62. In other words, the second connecting plate 62 guides the air in the element cooling passage 67 to flow toward the electric heating element 25.

The cooling fan 51 is disposed at one side of the flow guide 60, and the second connecting plate 62 is disposed at the other side (opposite to the side where the cooling fan 51 is located) of the flow guide 60. The guiding plate 63 is spaced apart upwardly from the electric heating element 25, to guide the air flowing in the element cooling passage 67 to the electric heating element 25.

Hereinafter, the operation of the cooling unit 50 will be described.

Figure 4:
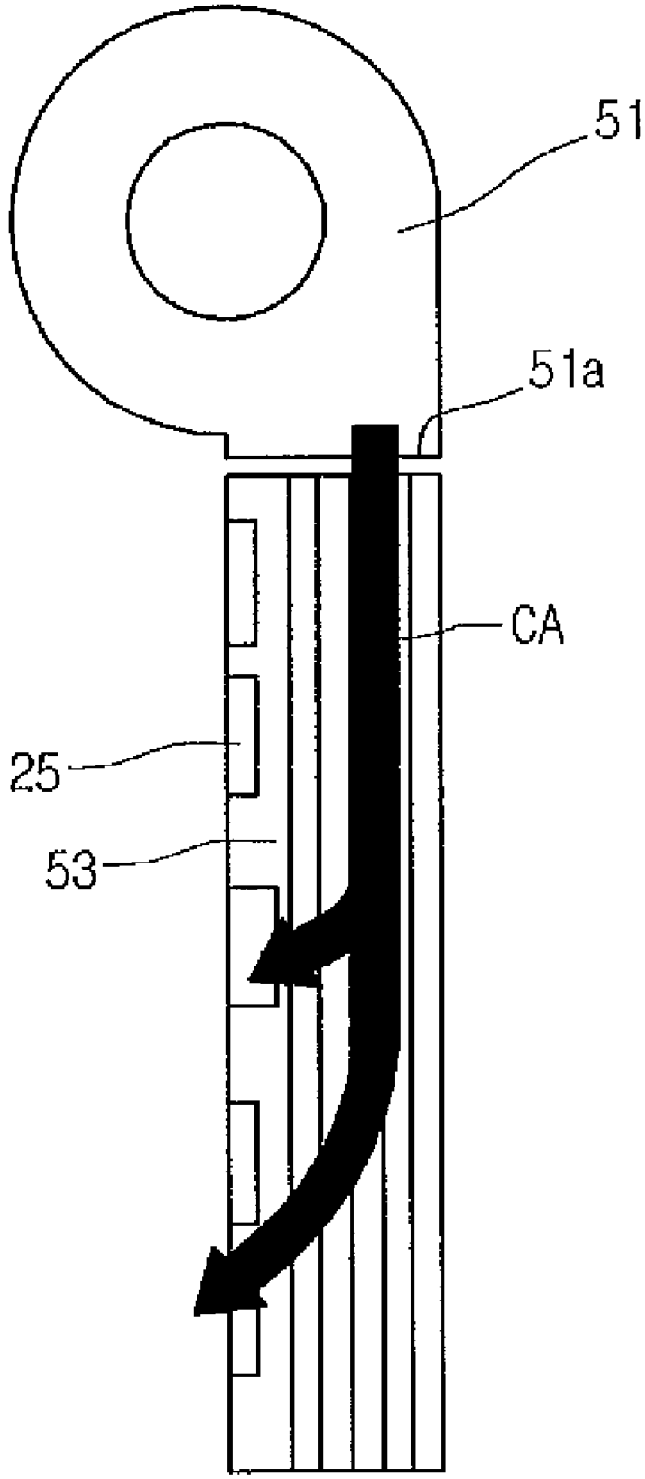
FIG. 4 is a diagram illustrating a flow of cooling air according to the first embodiment of the present invention.

FIG. 4 is a diagram illustrating a flow of cooling air of the first embodiment. In FIG. 4, the flow guide 60 is omitted. The cooling air CA illustrated in FIG. 4 indicates the cooling air that flows through the element cooling passage 67. Referring to FIGS. 1-4, when electricity is supplied to the cooking appliance 1, the cooling fan 51 rotates. Then, air is introduced into the inside of the case 10 through the cooling air suction port 11. Here, although the cooling air suction port 11 is provided in the front of the case 10, the suction port 11 may alternatively be provided in the case 10 vertically below the cooling fan 51.

The air suctioned through the suction port 11 is introduced into the inside of the cooling fan 51 and then is discharged through the discharge hole 51*a*. Specifically, a portion of the cooling air discharged through the discharge hole 51*a* flows into the bottom cooling passage 55, and another portion of the cooling air discharged through the discharge hole 51*a* flows into the top cooling passage 56. The remaining portion of the cooling air, i.e., the above-described cooling air CA, discharged through the discharge hole 51*a* flows into the element cooling passage 67. A portion of the cooling air CA flowing into the second cooling passage 67 moves directly toward the electric heating element 25, and a remaining portion of the cooling air CA collides with the second connecting plate 62 and then move toward the electric heating element 25.

According to this embodiment, the cooling air CA flowing through the element cooling passage 67 directly contacts the electric heating element 25, thereby cooling the electric heating element 25 rapidly and preventing malfunction thereof.

Figure 5:
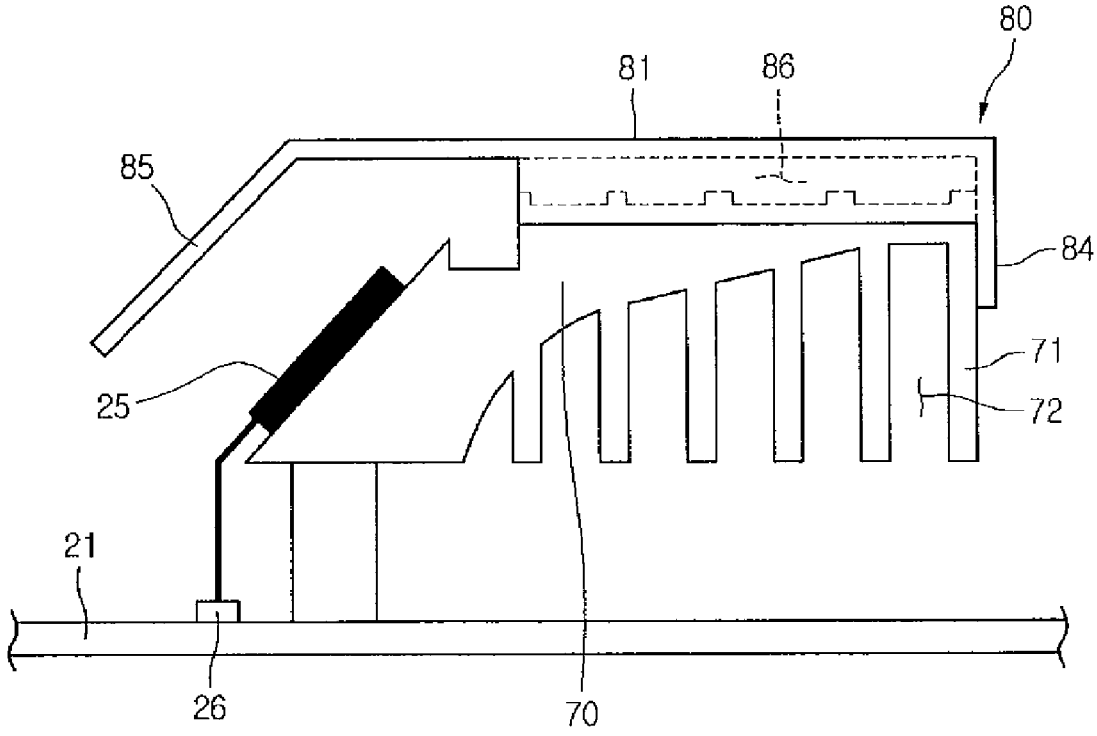
FIG. 5 is a cross-sectional view of a cooling unit according to a second embodiment of the present invention.
Figure 6:
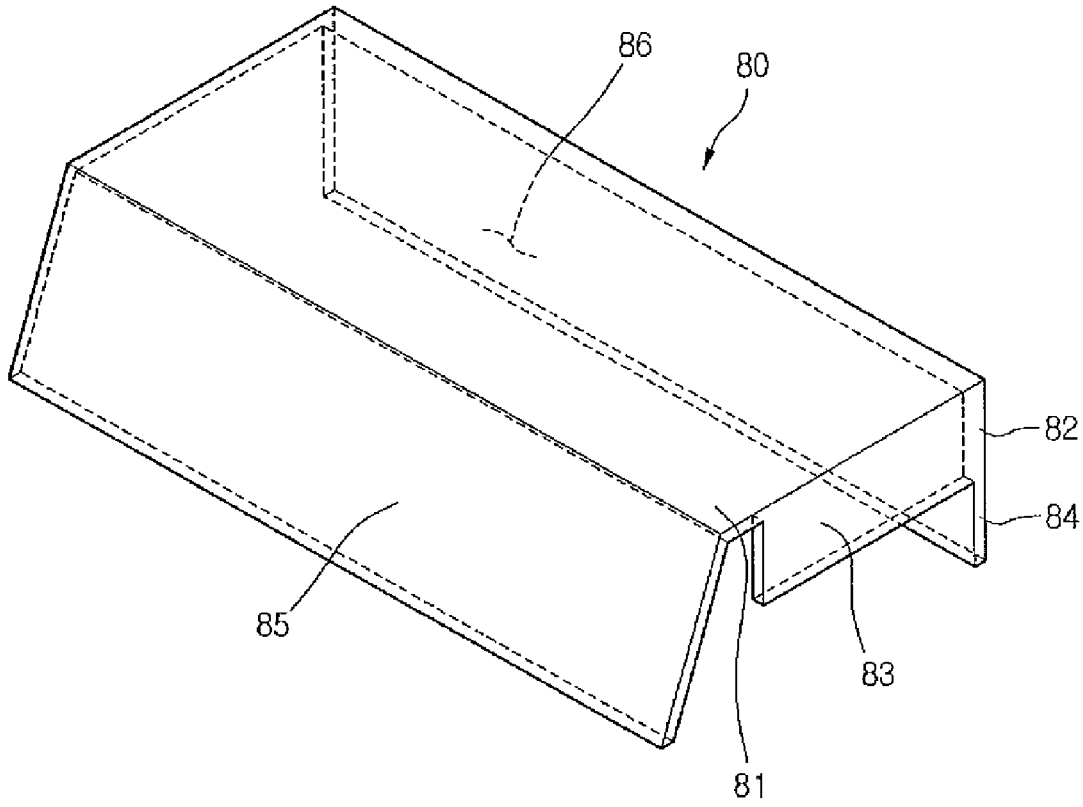
FIG. 6 is a perspective view of a flow guide according to the second embodiment of the present invention.

FIG. 5 is a cross-sectional view of a cooling unit according to a second embodiment of the present invention, and FIG. 6 is a perspective view of a flow guide according to the second embodiment. Elements in this embodiment are the same as their counterparts in the first embodiment except for the structures of the flow guide and the heat sink. Thus, only the characteristic features of the second embodiment will be described, and the features already described by the first embodiment will be omitted.

Referring to FIGS. 5 and 6, a plurality of heating fins 71 are formed at the bottom of a heat sink 70 according to the second embodiment. The heating fins 71 are spaced apart from each other by a predetermined distance, and each cooling passage 72 is formed between two immediately adjacent heating fins 71.

A flow guide 80 is located above the heat sink 70. The flow guide 80 includes a cover 81, a first side plate 82, a second side plate 83, a guiding plate 85, and a coupling plate 84. The cover 81 is spaced apart upwardly from the heat sink 70. The first side plate 82 extends downward from the first end of the cover 81, and the second side plate 83 extends downward from the second end of the cover 81. The guiding plate 85 extends slantingly downward from the cover 81. The coupling plate 84 extends downward from the first side plate 82, to be coupled to the heat sink 70.

When the flow guide 80 is coupled to the heat sink 70, an element cooling passage 86 is formed between the cover plate 81 and the top of the heat sink 70. Here, the cooling passage 72 formed by the heating fins 71 is designated as a first cooling passage, and the element cooling passage 86 formed between the cover plate 81 and the heat sink 70 is designated as a second cooling passage.

The operation of the cooling unit will be described below.

Figure 7:
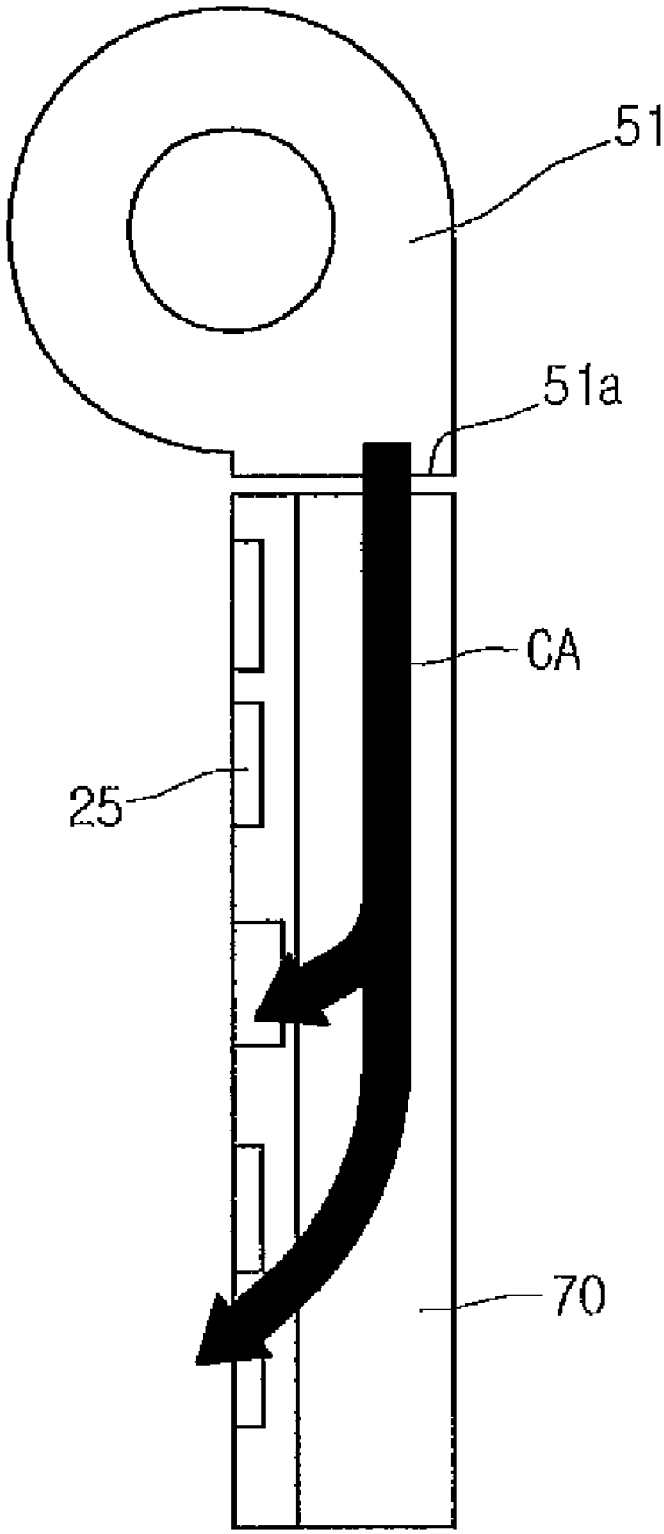
FIG. 7 is a diagram illustrating a flow of cooling air according to the second embodiment of the present invention.

FIG. 7 is a diagram illustrating a flow of cooling air of the second embodiment. In FIG. 7, the flow guide 80 is omitted. The cooling air CA illustrated in FIG. 7 indicates the cooling air that flows through the element cooling passage 86. Referring to FIGS. 5-7, when the cooling fan 51 operates, the cooling fan 5 discharges cooling air through a discharge hole 51*a* thereof.

In detail, the cooling air discharged through the lower of the discharge hole 56 flows into the first cooling passage 72, and the cooling air CA discharged through the upper of the discharge hole 56 flows into the second cooling passage 86. A portion of the cooling air CA flows toward the electric heating element 25, and the remaining portion of the cooling air CA reaches the second side plate 83 and flows toward the electric heating element 25. As a result, the amount of the cooling air flowing toward the electric heating element 25 increases, thereby cools the electric heating element 25 rapidly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooking appliance comprising:

at least one heating element;

a heat sink to radiate heat generated by the at least one heating element, the at least one heating element being mounted to an upper mounting surface of the heat sink;

a cooling fan located at one side of the heat sink, to blow cooling air to the heat sink; and a flow guide provided at an outer side of the heat sink, for covering at least a portion of the heat sink and guiding a portion of the cooling air to flow to the heating element, at least a portion of the flow guide being provided above the at least one heating element, wherein the flow guide and the upper mounting surface of the heat sink define an element cooling passage therebetween, to allow the cooling air to directly flow to the at least one heating element via the element cooling passage, and the element cooling passage is provided at the outer side of the heat sink, and wherein the at least one heating element is provided completely between the flow guide and the upper mounting surface of the heat sink.

2. The cooking appliance according to claim 1, wherein the flow guide comprises a separating element separating and guiding the cooling air to flow along the heat sink and toward the at least one heating element, respectively.

3. The cooking appliance according to claim 1, wherein the heat sink comprises a plurality of heating fins, wherein a first cooling passage is respectively defined between every two immediately adjacent heating fins, the element cooling passage is separated from the first cooling passage, and the element cooling passage is provided above the first cooling passage.

4. The cooking appliance according to claim 3, wherein the flow guide comprises a separating element separating the first cooling passage from the element cooling passage.

5. The cooking appliance according to claim 3, wherein the flow guide comprises a guiding element guiding the cooling air in the element cooling passage to flow toward the at least one heating element, and the guiding element is provided above the at least one heating element and the heat sink.

6. The cooking appliance according to claim 3, wherein the flow guide comprises:

a bottom plate in contact with the heating fins;

a top plate spaced apart from the bottom plate; and a connecting plate connecting the top plate to the bottom plate, and guiding the cooling air in the element cooling passage to flow toward the at least one heating element.

7. The cooking appliance according to claim 3, wherein the first cooling passage is defined at a first side of the heat sink and the element cooling passage is defined at a second side of the heat sink, the second side being opposite to the first side.

8. The cooking appliance according to claim 3, wherein the flow guide comprises a cover element spaced apart upwardly from the heat sink, wherein the cover element and the top of the heat sink define the element cooling passage.

9. The cooking appliance according to claim 1, wherein the upper mounting surface faces the flow guide.

10. A cooking appliance comprising:

a heating element;

a heat sink configured to dissipate heat of the heating element;

a cooling fan configured to provide cooling air; and a flow guide provided at an outer side of the heat sink, for defining an element cooling passage to guide the cooling air blown by the cooling fan to directly flow toward the heating element, wherein the heat sink and the flow guide are provided as separate parts, and the element cooling passage is provided at the outer side of the heat sink, and wherein the heating element is disposed between a first surface of the heat sink and at least a portion of the flow guide, the element cooling passage is defined between the first surface of the heat sink and at least the portion of the flow guide, and the cooling air in the element cooling passage flows to the heating element and wherein the heating element is mounted to the first surface of the heat sink, and the heating element is provided completely between the flow guide and the first surface of the heat sink.

11. The cooking appliance according to claim 10, wherein the flow guide is coupled to the heat sink.

12. The cooking appliance according to claim 10, wherein the heat sink comprises a plurality of heating fins, a cooling passage respectively defined between every two immediately adjacent heating fins.

13. The cooking appliance according to claim 10, wherein the flow guide comprises a cover element spaced apart from the heat sink, to cover the heat sink and define the element cooling passage.

14. The cooking appliance according to claim 13, wherein a guiding element extends from the cover element, to guide the cooling air in the element cooling passage to flow toward the heating element, and the guiding element is provided above the heating element and the heat sink.

15. The cooking appliance according to claim 10, wherein the first surface of the heat sink faces at least the portion of the flow guide.

16. A cooking appliance comprising:

a base;

an electric element located in the base;

a heat sink connected to the electric element and including a plurality of heating fins;

a first cooling passage defined between every two immediately adjacent heating fins;

a flow guide provided at an outer side of the heat sink, for defining a second cooling passage separated from the first cooling passage, to cool the electric element; and a cooling fan blowing cooling air into the first cooling passage and the second cooling passage, wherein the second cooling passage is provided at the outer side of the heat sink, wherein the first cooling passage is spaced apart from the second cooling passage, and the flow guide includes a guiding element changing a flowing direction of cooling air in the second cooling passage toward the electric element, and wherein the electric element is mounted to an upper mounting surface of the heat sink, and the electric element is located completely between the guiding element and the upper mounting surface of the heat sink.

17. The cooking appliance according to claim 16, wherein the flow guide comprises a separating element in contact with the heating fins, to separate the first cooling passage and the second cooling passage, and the separating element is disposed on an upper side of the heating fins.

18. The cooking appliance according to claim 17, wherein the flow guide comprises a top element spaced apart from the separating element, to define the second cooling passage between the separating element and the top element.

19. The cooking appliance according to claim 16, wherein the heating fins are located at a bottom of the heat sink, and the flow guide and a top surface of the heat sink define the second cooling passage.

20. The cooking appliance according to claim 16, wherein the cooling air flowing through the second cooling passage directly contacts the electric element.

* * * * *